United States Patent [19]

Parikh

[11] 4,148,633

[45] Apr. 10, 1979

[54] MINIMIZATION OF EDGE CRACKING DURING HOT ROLLING OF SILICON-TIN BRONZES

[75] Inventor: Prakash D. Parikh, Hamden, Conn.

[73] Assignee: Olin Corporation, New Haven, Conn.

[21] Appl. No.: 845,470

[22] Filed: Oct. 26, 1977

[51] Int. Cl.[2] ..... C22C 9/02; C22F 1/08

[52] U.S. Cl. ..... 75/154; 75/160; 148/11.5 C; 148/12.7 C

[58] Field of Search ..... 75/154, 160; 148/11.5 C, 12.7 C

[56] References Cited

U.S. PATENT DOCUMENTS

| | | | |
|---|---|---|---|
| 1,956,251 | 4/1934 | Price | 75/160 |
| 1,987,639 | 1/1935 | Roberts | 75/160 |
| 2,035,414 | 3/1936 | Wilkins | 75/154 |
| 2,052,523 | 8/1936 | Wilkins | 75/154 |
| 2,062,448 | 12/1936 | Deitz, Jr. et al. | 75/154 |
| 2,257,437 | 9/1941 | Weiser | 75/154 |
| 2,706,154 | 4/1955 | Colton | 75/154 |
| 3,923,555 | 12/1975 | Shapiro et al. | 285/38 |

FOREIGN PATENT DOCUMENTS

| | | | |
|---|---|---|---|
| 46-1700 | 1/1971 | Japan | 75/154 |

*Primary Examiner*—W. Stallard
*Attorney, Agent, or Firm*—Paul Weinstein

[57] ABSTRACT

Particular copper base alloys consisting essentially of silicon, tin and mischmetal are disclosed which exhibit improved resistance to edge cracking during hot working operations. Various other elements such as chromium, manganese, iron and nickel may also be added to the alloy to increase the strength properties of the alloy without affecting the hot workability improvement brought about by the mischmetal addition to the copper-silicon-tin base.

11 Claims, 3 Drawing Figures

ALLOY WITH MISCHMETAL

ALLOY WITHOUT MISCHMETAL

ALLOY WITH MISCHMETAL

ALLOY WITHOUT MISCHMETAL

ALLOY WITH MISCHMETAL

MINIMIZATION OF EDGE CRACKING DURING HOT ROLLING OF SILICON-TIN BRONZES

BACKGROUND OF THE INVENTION

The commercial production of wrought copper base alloys is seriously affected by edge cracking of the alloys during hot rolling or working. Silicon-tin bronzes in particular are susceptible to the edge cracking phenomenon because of the tendency of the silicon and tin elements to segregate in the alloy during casting. Ternary alloys which contain silicon and tin are even more susceptible to the edge cracking phenomenon, but these ternary alloys are nonetheless desirable for commercial production because they provide a good combination of stress corrosion resistance, high strength and formability.

Various means have been employed to counteract the edge cracking phenomenon of such alloys. Such means have included both different combinations of elemental additions and ways to vary the hot working process. For example, copper alloys which contain impurities such as lead and bismuth, as outlined in "A Preliminary Assessment of the Value of Minor Alloy Additions in Counteracting the Harmful Effect of Impurities on the Hot Workability of Some Copper Alloys" by R. J. Jackson et al. in the *Journal of the Institute of Metals,* Volume 98 (1970), Pages 193 through 198, may have their tendencies to crack during hot working reduced by the addition of such materials as thorium, uranium and mischmetal. These copper base alloys include admiralty brass, nickel silver, cupro nickel and 95/5 phosphor bronze. Ductility increases (or increases in hot workability) have also been noted for a mischmetal-phosphorus copper base alloy in "Effect of Misch Metal on Mechanical Properties of Some Industrial Copper Based Alloys" by U. K. Duysemaliyev in the *Transactions of the Institute of Metallurgy and Beneficiation of the Academy of Sciences of The Kazakh SSR, Metallography and Pressure Working of Metals,* Volume 10, No. 3 (1964), Pages 55 through 58. In this particular article, it has been discovered that mischmetal in amounts of approximately 0.05 to 0.5%, when added to copper-zinc alloys, increases the ductility of such alloys. In neither of these articles is the addition of such materials as mischmetal to silicon-tin copper base alloys disclosed.

Another method of counteracting stress corrosion failure in copper base alloys is indicated in U.S. Patent No. 3,923,555, which is assigned to the same Assignee as the present invention. This patent in particular describes a copper base alloy which consists essentially of from 1 to 4.5% silicon, from 1 to 5% tin, balance copper wherein the total silicon plus tin content is at least 3.5%. This particular alloy system provides copper base alloys which have high mechanical strength, excellent stress corrosion resistance and also good general corrosion resistance. These particular alloys are quite useful for purposes which require good formability in the particular alloys being worked.

It is therefore a primary object of the present invention to provide a copper base alloy which is resistant to edge cracking during hot working.

It is an additional object of the present invention to provide an alloy as above which reduces said edge cracking through an elemental addition to the alloy, rather than a particular method of hot working.

It is a further object of the present invention to provide an alloy as above which utilizes an elemental addition which is readily available.

Further objects and advantages of the present invention will become more apparent from a consideration of the following specification.

SUMMARY OF THE INVENTION

The foregoing objects and advantages are readily accomplished by providing a copper base alloy which consists essentially of silicon, tin, mischmetal, balance copper. Minor additions of chromium, manganese, iron and nickel may also be made to the alloy to improve the strength of the alloy without deleteriously affecting the hot workability of the alloy brought about by the mischmetal addition.

DETAILED DESCRIPTION

Figure 1:
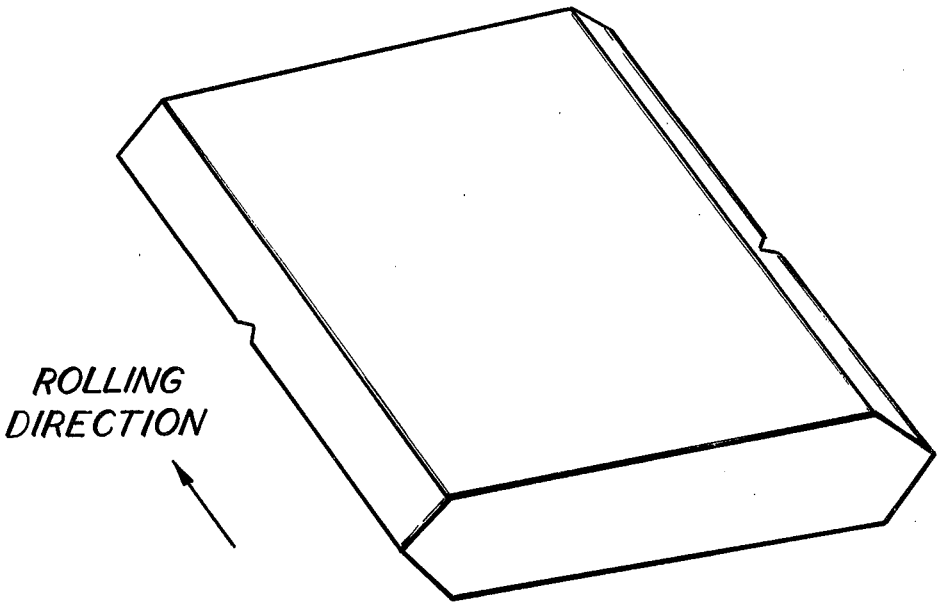
FIG. 1 is a perspective view of the tapered edge specimen utilized to test susceptibility of edge cracking of copper base alloys during hot working.

The alloy of the present invention consists essentially of from 2 to 4.0% by weight silicon, from 0.5 to 3.0% by weight tin, provided that the total silicon plus tin content present in the alloy is less than or equal to 6.0% by weight. To this alloy system is added mischmetal in an amount ranging from 0.005 to 0.1% by weight. The balance of the alloy consists essentially of copper.

The alloy of the present invention preferably consists essentially of from 2 to 3.5% by weight silicon, from 0.5 to 2.5% by weight tin, balance copper. To these conditions is added the further and concurrent condition that the total silicon plus tin content present in the alloy be less than or equal to 5.5% by weight. Mischmetal may be added to this preferred alloy system in an amount ranging from 0.01 to 0.05% by weight. It is important to stress again that, not only for the preferred percentages outlined above but also for the broad percentages, both the actual percentages for silicon and tin as well as the total silicon plus tin content must be satisfied at the same time.

It should be noted that the addition described above as "mischmetal" is generally well known as a mixture of cerium, lanthanum and Rare Earth metals. Cerium and lanthanum together comprise approximately 95% of the weight of mischmetal.

The alloys of the present invention provide a desirable combination of stress corrosion resistance, high strength and good formability or ductility. This combination of properties is particularly useful in such applications as electrical contacts and other items which require fairly extensive fabrication.

The main problem encountered by such alloys is cracking of the edges of sheet material formed from the alloys during hot working processes. The severity of this edge cracking increases with increasing amounts of silicon and tin in the alloys. Such edge cracking provides for considerable waste in the forming of these alloys into useful wrought shapes. Therefore, any method of reducing the edge cracking not only takes full advantages of the properties of such alloys, but also provides for increased productivity in the formation of wrought products from such alloys.

The processing of the alloy system of the present invention generally follows along the same lines as the processing outlined in U.S. Pat. No. 3,923,555, described above. In other words, the alloys of the present invention may first be cast by any suitable method and preferably by direct chill or continuous casting methods in order to provide a better cast structure to the alloy. After this casting step, the alloy is preferably heated to between 600° C. and the solidus temperature of the particular alloy within the system for at least 15 minutes. The alloy is then hot worked from a starting temperature in excess of 650° C. up to within 20° C. of the particular solidus temperature. The temperature at the completion of the hot working step should be greater than 400° C. It should be noted that the particular solidus temperature of the alloy being worked will depend upon the particular amounts of silicon, tin and mischmetal within the alloy as well as any other minor additions present in the alloy. The particular percentage reduction during the hot working step is not particularly critical and will depend upon the final gage requirements necessary for further processing.

After being hot worked, the alloy should then be subjected to an annealing temperature between 450° and 600° C. for approximately ½ to 8 hours. This annealing temperature should preferably be between 450° and 550° C. for ½ to 2 hours. This particular annealing step can be utilized either after the hot working step or with subsequent processing of the alloy to make a product. Depending upon desired properties, the alloy can be cold worked to any desired reduction with or without intermediate annealing to form either temper worked strip material or heat treated strip material. A plurality of cold working and annealing cycles may be employed in this particular step of the process.

The processing procedure should contain a heat treatment step either in the interannealing procedure or as a final annealing procedure in order to obtain improvement in the strength to ductility relationship in the alloy. This heat treatment step should be performed at a temperature between 250° and 850° C. for at least 10 seconds. If a heat treatment step on a final formed part is desired in order to provide greater stress relaxation properties in the part, this particular heat treatment step should be performed at a temperature between 150° and 400° C. for from 15 minutes to 8 hours.

The desirable attributes of the alloy of the present invention may readily be seen from a consideration of the following example.

EXAMPLE

Figure 2:
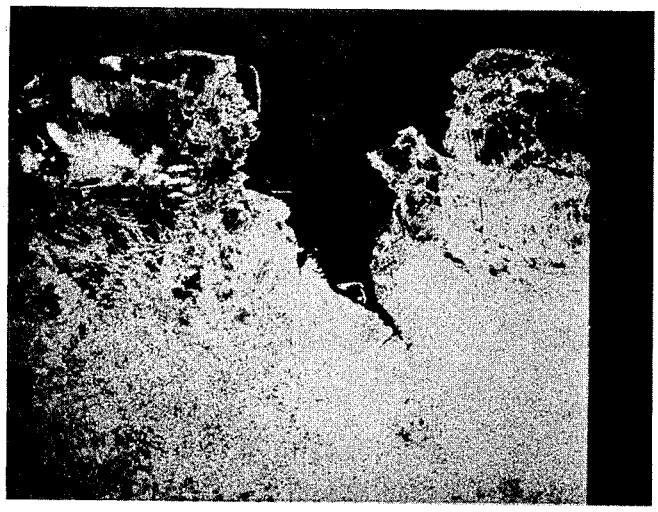
FIG. 2 consists of two photomicrographs at a magnification of 7× showing the cracking at the notched area in the specimen of FIG. 1 for alloys both within the present invention and not contemplated by the present invention.
Figure 2:
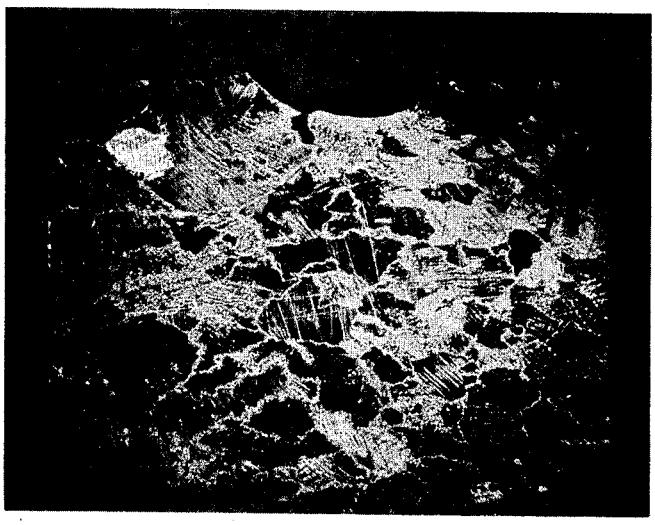
Figure 3:
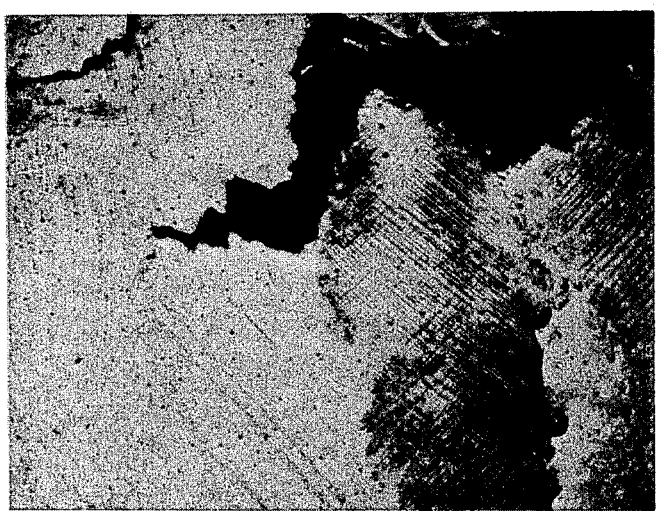
FIG. 3 consists of two photomicrographs at a magnification of 30× of etched (using a ferric chloride etchant) alloys taken away from the notched area in the specimen of FIG. 1 for alloys within the present invention and not contemplated by the present invention.
Figure 3:
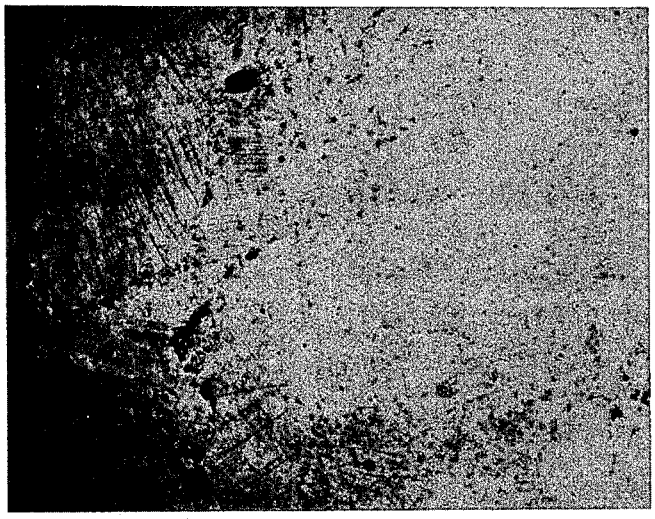

Tapered edge hot rolling specimens such as that shown in FIG. 1 were cut and formed from 10 lb. castings of alloys having a composition of, respectively, Cu-3.5%Si-2% Sn and Cu-3.3%Si-2.2%Sn-0.01%MM (mischmetal). Both of these alloys were cast utilizing the same casting practice and the alloy specimens were soaked at 750° C. for one hour prior to hot rolling. The specimens utilized both tapered edges and notches since the taper induces tensile stress at the edges while the notch promotes stress concentration. Both of these stress concentration situations simulate conditions of an alloy sheet edge during commercial hot rolling of large ingots. After the one hour soak at 750° C., both samples were then hot rolled at 750° C. with two passes of approximately 20% reduction during each pass. The notched area was then specifically examined to determine the cracking tendency of each sample. FIG. 2 shows low power (7×) photomicrographs of the notched area of each specimen after sectioning the specimens parallel to the rolling plane. The cracking in the notch area can clearly be seen in the alloy without the mischmetal addition. The specimen of the alloy of the present invention can be seen to exhibit only a minor crack at the notch. Higher magnification (30×) of the specimens away from the notch area, as shown in FIG. 3, indicates that the alloy containing mischmetal exhibits only isolated cavities while the alloy without the mischmetal tends to show continuous cavities along the grain boundaries of the alloy. The photomicrograph of the alloy specimen without mischmetal also shows that the hot rolling deformation is not homogeneous and is generally confined to the grain boundaries in the alloy. As a result, the alloy without mischmetal is much more prone to cracking than the alloy containing mischmetal.

It can be concluded from the example and the photographs that the addition of mischmetal to a copper-silicon-tin alloy greatly increases the resistance of the alloy to edge cracking during hot working. Minor additions of other elements such as chromium, manganese, iron and nickel up to a total of 0.5% by weight may also be added to the alloy of the present invention to increase the strength properties of the alloy without affecting the hot workability improvement brought about by the mischmetal addition.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. An alloy which exhibits high resistance to edge cracking during hot working, said alloy consisting essentially of 2 to 4.0% by weight silicon, 0.5 to 3.0% by weight tin, with a total silicon plus tin content to less than or equal to 6.0% by weight, 0.005 to 0.1% by weight mischmetal, balance copper.

2. An alloy as in claim 1 wherein an element selected from the group consisting of chromium, manganese, iron and nickel in amounts up to 0.5% by weight in total is added to said alloy.

3. An alloy as in claim 1 which consists essentially of from 2 to 3.5% by weight silicon, 0.5 to 2.5% by weight tin, with a total silicon plus tin content of less than or equal to 5.5% by weight, 0.01 to 0.05% by weight mischmetal, balance copper.

4. An alloy as in claim 3 wherein an element selected from the group consisting of chromium, manganese, iron and nickel in amounts up to 0.5% by weight in total is added to said alloy.

5. A process for forming an alloy which exhibits high resistance to edge cracking during hot working, said process comprising:

(a) providing a copper base alloy which consists essentially of 2 to 4.0% by weight silicon, 0.5 to 3.0% by weight tin, with a total silicon plus tin content of less than or equal to 6.0% by weight, 0.005 to 0.1% by weight mischmetal, balance copper;

(b) hot working said alloy from a starting temperature in excess of 650° C. up to within 20° C. of the solidus temperature of the alloy, with a temperature at the completion of the hot working step in excess of 400° C.;

(c) cold working the alloy to the desired gage; and (d) annealing the alloy at a temperature between 450° and 600° C. for from ½ to 8 hours.

6. A process as in claim 5 wherein an element selected from the group consisting of chromium, manganese, iron and tin in amounts up to 0.5% by weight in total is added to said alloy.

7. A process as in claim 5 wherein prior to hot working the alloy is heated at a temperature between 600° C. and the solidus temperature of the alloy for at least 15 minutes.

8. A process as in claim 5 wherein the alloy is annealed at a temperature between 450° and 600° C. for ½ to 8 hours immediately following said hot working.

9. A process as in claim 5 wherein said cold working and annealing steps are repeated at least once.

10. A process as in claim 5 wherein the annealing temperature is between 450° and 550° C. and the annealing time is between ½ and 2 hours.

11. A process as in claim 5 wherein the product formed from the processing steps is formed into a part and said part is heat treated at a temperature between 150° and 400° for from 15 minutes to 8 hours.

* * * * *